United States Patent [19]

Petrov et al.

[11] 4,450,675

[45] May 29, 1984

[54] METHOD OF AND APPARATUS FOR THE PRODUCTION OF FANCY YARNS

[75] Inventors: Georgi M. Petrov; Kiril K. Boev; Igor A. Fidelski; Yordan T. Pirgov, all of Sofia, Bulgaria

[73] Assignee: Institute PO Obleklo I Textil, Sofia, Bulgaria

[21] Appl. No.: 342,771

[22] Filed: Jan. 26, 1982

[30] Foreign Application Priority Data

Jan. 26, 1981 [BG] Bulgaria ..... 50541

[51] Int. Cl.[3] ..... D02G 3/34; D02G 3/38

[52] U.S. Cl. ..... 57/6; 57/5; 57/12; 57/328

[58] Field of Search ..... 57/3, 5, 6, 12, 13, 57/15, 328, 333, 350, 351, 908, 2, 315; 28/255, 258

[56] References Cited

U.S. PATENT DOCUMENTS 800,013 9/1905 Phillips et al. ..... 57/5

4,302,926 12/1981 Maixner et al. ..... 57/3 X R 4,304,092 12/1981 Bridges et al. ..... 57/6 X R

*Primary Examiner*—Donald Watkins

[57] ABSTRACT

Method and apparatus for the production of fancy yarns from falsely twisted core and fancy threads. Staple fibers are drafted by a cylindrical drafter; the core and fancy threads are false twisted by a hollow spindle. At least one drafting of staple fibers are supplied upon the falsely twisted core and fancy threads by means of a pneumatic transporting channel. The speed of the fibers constituting the fancy threads is greater than the peripheral speed of the rollers delivering the core thread. If desired, two rovings of staple fibers may be used, the two rovings having different titre in a ratio of 1:10 and having different lengths of the fibers in a ratio of above 1:2, both rovings entering from one drafter, the two rovings after being drawn being supplied together to the combined false twisted core thread and fancy thread.

6 Claims, 4 Drawing Figures

METHOD OF AND APPARATUS FOR THE PRODUCTION OF FANCY YARNS

This invention relates to a method of and an apparatus for producing fancy yarns from a false twisted core, fancy thread and staple fibers for binding.

A method and apparatus are known for the drawing of a sliver or roving, the fibers and the core thread are directed toward two rotating perforated drums and air is sucked from within them so there can start a false twist in the fiber sliver and core thread emerging from the drafter. From a sliver, fibers are drawn by a carding roller and are supplied longituninally along the perforated drums which bind the false twist of the fiber sliver and the core thread. Such system is known by the designation "DREF-3".

A device is known for the setting of the false twist in the core yarn of staple fibers thereon (USSR Pat. No. 445,210). In such device, from one drafter there are supplied fibers which are fed toward the false twisted thread made of staple fibers, the fibers being fed through a channel by vacuum. A smooth core yarn without loops is produced by such device. A device is known for obtaining fancy yarns (U.S. Pat. No. 2,439,732 - B2), wherein for a core there is used a previously produced thread (yarn), and for the fancy yarn there is employed a ready-made thread or a fiber sliver made from a roving. Upon a hollow spindle with an element for imparting a false twist there is placed a package with a binding thread wound upon it. When passing through the hollow spindle and the false twisting element, the core thread and the fancy threads are false twisted, and as a result of the spindle rotation are bound by twisting with the thread which is unwound from the said spindle.

The disadvantages of the known devices are that by using rotating perforated drums for a false twist there cannot be achieved a sufficient compactness of the fibers for binding the flase twist, and the effects are displaced. Furthermore, the perforated drums, the drafter, and the carding roller form a complex combination, requiring a high-energy input. The use of a binding thread carried by the rotating hollow spindle has the disadvantage that it requires a change of the package when the package is exhausted, and thus renders the process intermittent. A specific device is also needed for winding a binding thread around the package, and the rotation of this package, with its relatively great weight, thus limits the speed of thread production. In other solutions to the problem, wherein staple fibers are used for binding the false twist, the compactness of the core consisting of staple fibers only is insufficient, and the ready-made yarn has unbound sections, which to a great extent reduce its strength and make it practically unusable. In addition, the known methods and apparatus do not provide possibilities for the production of wide varieties of the yarns produced thereby.

The present invention has among its objects the elimination of the above outlined disadvantages of the prior art, and the provision of a method for the supply of staple fibers for the firm binding of the fancy yarn from false twisted threads at a high rate of production of the apparatus. The method of the invention can be employed with all kinds of fibers and ready-made threads in various assortments of threads of different titres and types.

In accordance with the method of the invention, toward one stretched core thread and at least one fancy thread (or bundle of staple fibers), falsely twisted along a transporting channel there are supplied staple fibers for binding, which come from a cylindrical drater. In the transporting channel, as a result of the underpressure of air and the respective dimensions of the channel, the fibers are additionally separated in it and at its exit end they have a speed greater than that of the delivering rollers. Falling upon the false twisted core and the fancy threads, the fibers are nipped in their ends and their free ends are stretched.

In order to carry out the method for the supply of fibers for fancy yarn production, a cylindrical drafter is used, allowing equal or different drafters of the fibers for binding and of the fibers for the fancy thread, a pair of rollers or a tension regulator of the core thread, which has a slower speed than that of the fancy thread and equal to that of the taking-up of the ready-made yarn, a transporting channel along which there are supplied the staple fibers for the binding, and the length of the said channel being greater than that of the fibers, a receiving (collecting) chamber with a narrowed entry and exit, and with double walls, the inner wall being perforated for the passing of the sucked air, which in the transporting channel provokes acceleration of the fibers and in the collecting chamber the free ends of the fibers are maintained stretched, nipped in their other ends by the core and fancy threads, a hollow spindle with a sucking unit, a device for imparting a false twist, placed upon the hollow spindle and at the end a known device for the winding of a ready-made yarn. In some cases, the sucking unit can deliver air toward the pneumatic device of the transporting channel.

The invention will be more readily understood upon consideration of the accompanying drawings, wherein.

Figure 1:
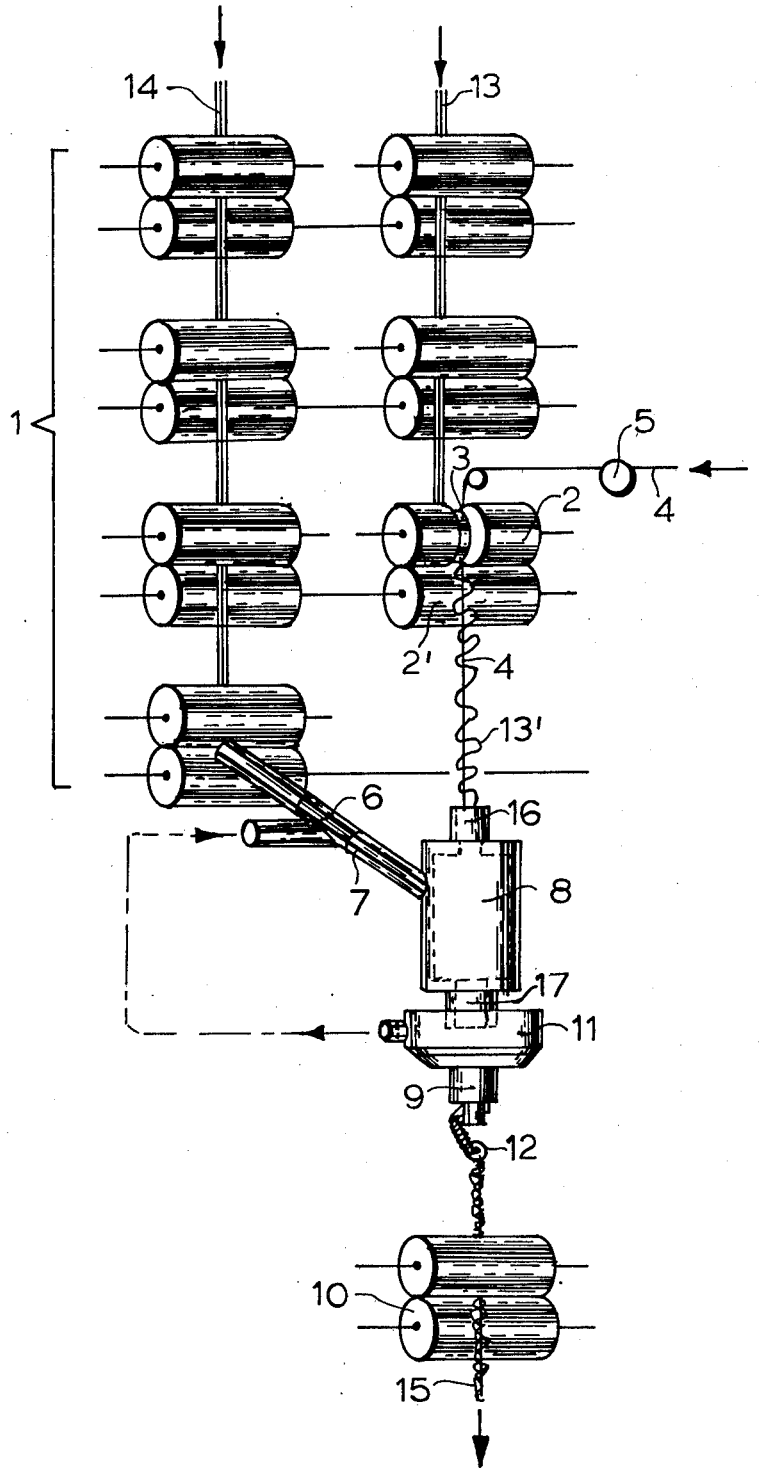
FIG. 1 is a general schematic view of a first embodiment of the apparatus of the invention.
Figure 2:
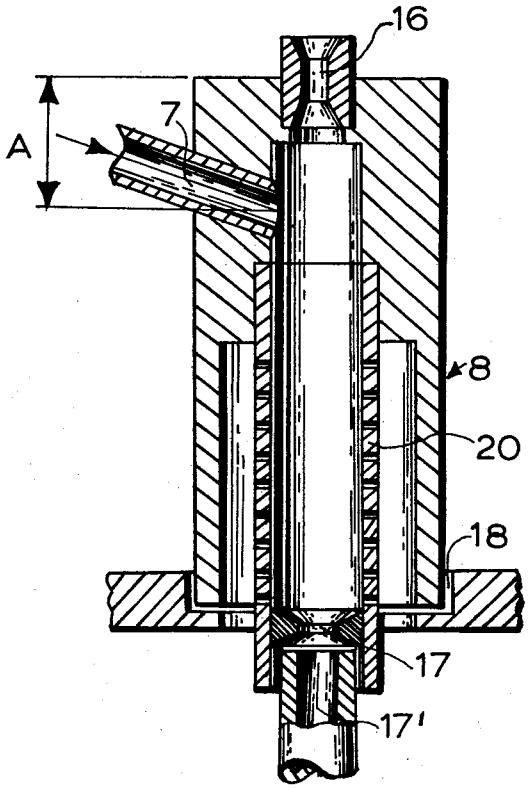
FIG. 2 is a view in section through a first embodiment of a collecting chamber which may be employed with the apparatus of FIG. 1, the collecting chamber of FIG. 2 having double walls and a place for supplying the fibers empoyed for the binding.

Turning first to FIGS. 1 and 2, the apparatus has a cylindrical drafter 1 which can achieve equal or different speeds for one working unit. A core thread 4 is fed past a tension controller 5 which may be in the form of a pair of rollers, whereby the core thread is suitably stretched. The core thread 4 then passes to an annular groove 3 of a roll 2 of a roll pair 2, 2'. A roving or sliver 13 is fed by pairs of cooperating nip rolls of the drafter 1, as shown, to the delivering roll pair 2,2' where it is combined with the core thread 4, as shown. The combined threads 4, 13 then enter the upper end 16 of the collecting chamber 8.

Another part of the drafter 1 supplies a binding 14 in the form of a roving or sliver through a plurality of pairs of cooperating nip rolls to the entering end of a transporting channel 7. Intermediate its length the channel 7, which is in the form of a conduit, is provided with a pneumatic feeding device 6 in the form of a pipe which is connected to the channel 7 and forms an acute angle with respect thereto so as to direct air downwardly through the lower end of the channel 7 and into the interior of the perforated inner wall 20 of the collecting chamber 8.

As shown in FIG. 2, the exit 17 of the collecting chamber 8 has an inner diameter which is three or four times greater than the diameter of the ready-made yarn 4 and reaches or is connected with the entry 17' of the rotatable hollow spindle 9. Spindle 9 has a sucking unit 11 (FIG. 1) for establishing an underpressure within it. As indicated in FIG. 1, air exhausted under an overpressure from the sucking unit 11 can be introduced into the pneumatic device 6 which supplies air under an overpressure to the channel 7, as indicated by the phantom line in FIG. 1.

The spindle 9 is also provided with a false twister 12 which is disposed at the exit end of the spindle. The spindle 9, as shown, is disposed between the exit end of the collecting chamber 8 and take-up rollers 10 for the final yarn product 15. As shown in FIG. 2, air under an overpressure travels downwardly in the channel 7, is fed within the inner, perforated cylindrical wall 20, passes radially outwardly through the perforations in the wall 20 into an annular outer chamber within the collecting chamber 8, and then escapes through the annular channel 18 into the sucking unit 11.

Two rovings 13 and 14 (or one sliver and one roving) enter the drafter 1 for one working unit, since from one roving 13 (or sliver) after drafting there are obtained the fibers for the fancy thread 13' and from the other roving 14 there are obtained the fibers for the binding. The fancy thread 13' moves toward the core thread 4 with a speed exceeding from 20% to 300% that of the taking-up rollers 10. In the zone downstream of the drafter 1, fancy thread 13' is falsely twisted with the core thread 4, which passes freely through the channel 3 of the pressing roller 2 or through a deviator (not shown) upstream of that roller. The fibers for the binding 14 enters through the transporting channel 7 to engage the combined false twisted core 4 and fancy threads 13' in the collecting chamber 8, the fibers for the binding 14 being nipped at one of their ends by the twisting threads 4, 13'. Thus such fibers reach the zone of the false twister 12 without receiving a twist because of the rotation of their free ends in the first zone of the false twist. After the false twisting device 12, in the process of untwisting, the nipped fibers are twisted with the combined core and fancy threads, making them firmly compact, and binding and fixing the formed effects (loops).

Figure 3:
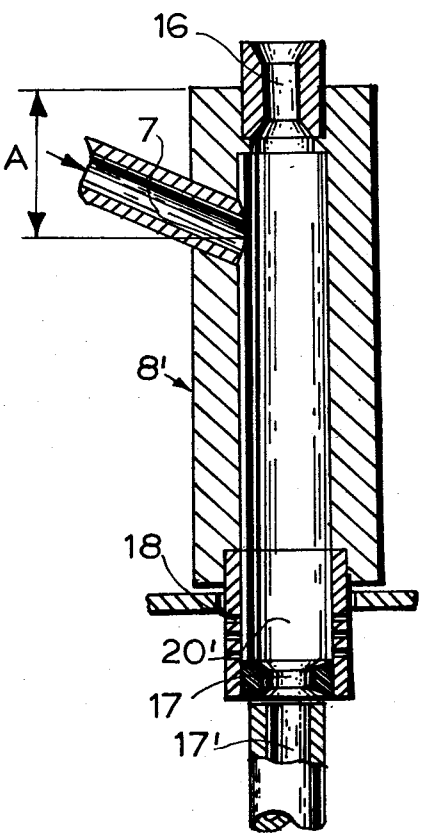
FIG. 3 is a view in cross section through a second embodiment of collecting chamber which may be employed in the apparatus of FIG. 1.

The binding is strengthened by the maintaining of a certain twist between the core 4 and the fancy threads 13', which has the direction of the twist in the section between the false twist device 12 and the taking-up rollers 10. The finally produced yarn 15, taken up by the pair of rollers 10, is wound by a known winding mechanism on a cylindrical or cone bobbin. By changing the distance A (FIG. 2) determining the place of supplying the fibers for the binding, it is possible to achieve effects of other characteristics i.e. thickened places (then the core thread may be missing), formed by the accumulation of the binding fibers In the alternative collecting chamber 8' shown in FIG. 3, the chamber proper has a single wall. Air is removed from the chamber through perforations through the wall of a short tube disposed at the exit end of the collecting chamber proper.

Figure 4:
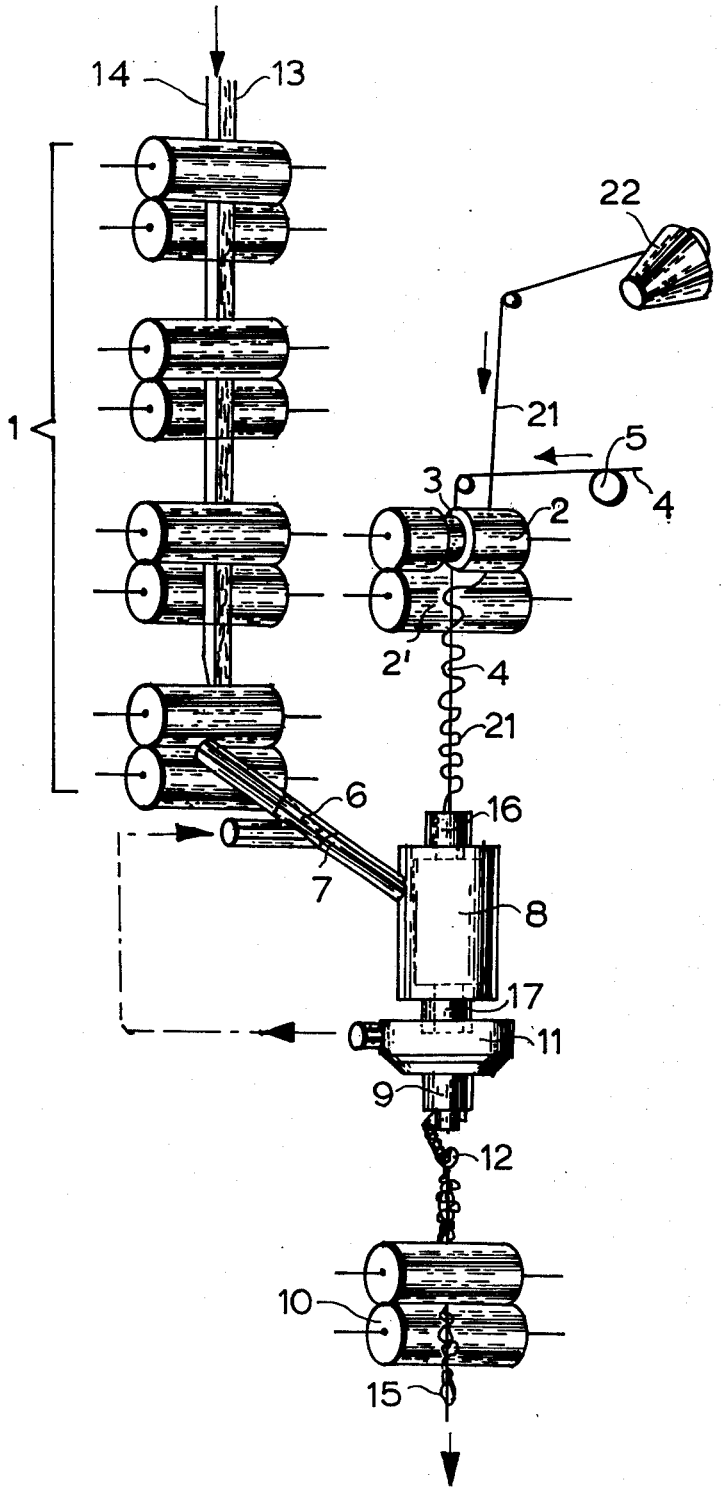
FIG. 4 is a view similar to FIG. 1 showing a second embodiment of the general combination of the elements of the apparatus.

In FIG. 4 there is shown a second embodiment of the apparatus; in FIG. 4 elements which are similar to those in FIG. 1 are designated by the same reference characters. In the apparatus of FIG. 4, the drafter 1 supplies a roving 14, composed of fibers for binding, and a roving (or sliver) 13, composed of fibers for the fancy thread. The two rovings are subjected to equal drawing. The roving 14 is considerably thinner (6 to 10 times) than the roving 13. The fibers of the roving 14 are shorter — up to 60mm, and the fibers of the roving 13 have a length of above 100mm.

The fibers of the two rovings coming out from the drafter 1 are supplied through air into the collecting chamber 8, wherein they are wound around the core thread 4. The fibers for binding, obtained from the roving 14, do not receive a twist in the span up to the false twisting element 12. After element 12, in the second zone for false twisting, they bind the false twist between the core thread 4 and the fancy thread 13 by twisting toward the pair to take-up rollers 10. The false twister and the sucking unit start functioning before the delivering rollers 2,2' and the drafter 1.

For varying the effects, there can be supplied from a bobbin 22 a ready-made thread 21 by feeding it forwardly through the nip of the circular cylindrical part of rollers 2,2'.

By the described method and apparatus all kinds of fibers and threads can be processed, since for binding there are used fibers of lengths up to 80mm. Because of the insignificant weight of the rotating device for performing the false twisting, and of the device for creating the underpressure air, a production speed of up to 250m per minute of the finished thread 15 can be used.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. Method for the production of fancy yarns from falsely twisted core and fancy threads, comprising drafting staple fibers by a cylindrical drafter and falsely twisting the core and fancy threads by a false twister carried by a hollow spindle, the staple fibers being produced from a cylindrical drafter which allows the simultaneous production of two different draftings for one working unit, feeding at least one of such draftings upon the falsely twisted core and fancy threads by means of a pneumatic transporting channel, the speed of the fibers constituting the fancy threads being greater than the peripheral speed of the rollers delivering the core thread.

2. Method in accordance with claim 1, wherein the two different draftings have different titre in a ratio of 1:10 and have different lengths of the fibers in a ratio of above 1:2, both draftings entering from one drafter, the two draftings after being drawn being supplied together to the false twisted core thread.

3. In apparatus for producing fancy yarns from falsely twisted core and fancy threads, having rollers for taking-up the yarn, rollers for delivering the fancy thread, and means for stretching and supplying the core thread with a speed equal to that of the taking-up rollers, the improvement which comprises a transporting channel with an air underpressure along which staple fibers in the drafting drawn by a cylindrical drafter are delivered for the binding of already formed effects, a false twister carried by a rotating hollow spindle, a receiving chamber with diameters at the entry and the exit exceeding the diameter of the core thread yarn by a maximum of three or four times, the hollow spindle carrying a sucking unit.

4. Apparatus according to claim 3, wherein the receiving chamber has double walls, the inner wall is perforated, and the exit end of the receiving chamber reaches or is connected with the entry of the rotatable hollow spindle.

5. Apparatus according to claim 3, wherein the transporting channel has a greater length than that of the fibers delivered by it.

6. Apparatus according to claim 3, wherein the distance determining the place of connection of the transporting channel with the receiving chamber can be varied in order to obtain thickened places formed by the drafting drawn by a cylindrical drafter which are delivered for the binding of already formed effects.

* * * * *